US010013903B2

(12) United States Patent
Lim et al.

(10) Patent No.: US 10,013,903 B2
(45) Date of Patent: Jul. 3, 2018

(54) SOURCE DRIVER INTEGRATED CIRCUIT AND GAMMA REFERENCE VOLTAGE GENERATOR

(71) Applicant: SILICON WORKS CO., LTD., Daejeon (KR)

(72) Inventors: HunYong Lim, Daejeon (KR); YongSuk Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 30 days.

(21) Appl. No.: 15/209,374

(22) Filed: Jul. 13, 2016

(65) Prior Publication Data

US 2017/0018249 A1 Jan. 19, 2017

(30) Foreign Application Priority Data

Jul. 14, 2015 (KR) ..... 10-2015-0099881

(51) Int. Cl.
*G09G 3/20* (2006.01)
*G09G 3/36* (2006.01)

(52) U.S. Cl.
CPC ..... *G09G 3/20* (2013.01); *G09G 3/3685* (2013.01); *G09G 3/3696* (2013.01); *G09G 2310/027* (2013.01); *G09G 2310/0291* (2013.01); *G09G 2310/0297* (2013.01); *G09G 2320/0233* (2013.01); *G09G 2320/0276* (2013.01); *G09G 2330/028* (2013.01)

(58) Field of Classification Search
CPC ..... G09G 3/20; G09G 3/3696; G09G 3/3685; G09G 2330/028; G09G 2320/0233; G09G 2310/0291; G09G 2310/027; G09G 2320/0276; G09G 2310/0297; G09G 2320/0673; G09G 3/3275; G09G 3/3283; G09G 3/3291; G09G 2300/043; G09G 2310/0259; G09G 2310/0272; G09G 2310/0275; G09G 2310/0281; G09G 2310/0294; G09G 2370/08; H04N 5/202; H04N 9/69; G06G 7/20; G06G 7/24; G06G 7/12; G06G 7/186
See application file for complete search history.

(56) References Cited

U.S. PATENT DOCUMENTS 9,478,163 B2 * 10/2016 Lee ..... G09G 3/2096
2007/0263127 A1 * 11/2007 Fainstain ..... H04N 5/202 348/674
2010/0157161 A1 * 6/2010 Tanahashi ..... H04N 5/202 348/675
2010/0182348 A1 * 7/2010 Okutani ..... G09G 3/3688 345/690
2010/0265274 A1 10/2010 Han et al.
(Continued)

FOREIGN PATENT DOCUMENTS

JP 2009-139441 A 6/2009
KR 10-0649884 B1 11/2006
KR 10-2009-0051792 A 5/2009

*Primary Examiner* — Vinh T Lam
(74) *Attorney, Agent, or Firm* — Fenwick & West LLP

(57) ABSTRACT

The present embodiments relate to a source driver integrated circuit and a gamma reference voltage generator, which can improve the image quality by preventing or reducing the wavy noise phenomenon, i.e. display of a pattern of stripe-shaped transverse lines on the screen.

14 Claims, 11 Drawing Sheets

(56) References Cited

U.S. PATENT DOCUMENTS

| | | | | |
|---|---|---|---|---|
| 2013/0181965 | A1* | 7/2013 | Su | G09G 3/3696 345/211 |
| 2014/0320546 | A1* | 10/2014 | Lim | G09G 3/3291 345/690 |
| 2015/0243230 | A1* | 8/2015 | Kim | G09G 3/3611 345/690 |
| 2015/0243239 | A1* | 8/2015 | Uemura | G09G 3/3614 345/209 |
| 2016/0148578 | A1* | 2/2016 | Kishi | G09G 3/3233 345/212 |

* cited by examiner

SOURCE DRIVER INTEGRATED CIRCUIT AND GAMMA REFERENCE VOLTAGE GENERATOR

CROSS REFERENCE TO RELATED APPLICATIONS

This application claims priority from Korean Patent Application Number 10-2015-0099881 filed on Jul. 14, 2015, which is hereby incorporated by reference in its entirety.

BACKGROUND

1. Field of the Invention

The present embodiments relate to a source driver integrated circuit and a gamma reference voltage generator.

2. Description of the Prior Art

Developments of information-oriented societies have been followed by variously increasing demands for display devices for displaying images, and various kinds of display devices have recently been used, such as liquid crystal display devices, plasma display devices, organic light-emitting display devices, and the like.

On the other hand, despite developments of various technologies for improving the image quality of display devices, there is a problem in that the image quality is degraded by a wavy noise phenomenon, i.e. display of a pattern of stripe-shaped transverse lines on the screen.

SUMMARY

An aspect of the present embodiments is to provide a source driver integrated circuit and a gamma reference voltage generator, which can improve image quality by preventing or reducing the wavy noise phenomenon, i.e. display of a pattern of stripe-shaped transverse lines on the screen.

In accordance with an aspect, the present embodiments may provide a source driver integrated circuit including: a latch circuit configured to store and output digital image data; a programmable-gamma circuit having a plurality of gamma amplifiers divided and arranged as N (N≥2) stages of gamma amplifier groups so as to output a gamma reference voltage; a digital analog converter configured to convert the digital image data, which has been output from the latch circuit, to an analog voltage on the basis of the gamma reference voltage and to output the analog voltage; and an output buffer configured to amplify and output the analog voltage.

In connection with a plurality of gamma amplifiers included in the source driver integrated circuit, an offset of the $i^{th}$ stage (i=2, . . . , N) of gamma amplifier group may correspond to an offset, which is delayed, of the $(i-1)^{th}$ stage of gamma amplifier group.

In accordance with another aspect, the present embodiments may provide a gamma reference voltage generator including: a plurality of gamma amplification circuits arranged in N (N≥2) stages; N−1 multiplexer circuits arranged between respective gamma amplification circuits; and a main resistor string connected to the $N^{th}$ stage of gamma amplification circuit.

In such a gamma reference voltage generator, an offset of each gamma amplifier included in the $i^{th}$ stage (i=2, . . . , N) of gamma amplification circuit, among the plurality of gamma amplification circuits, may correspond to an offset, which is delayed, of each gamma amplifier included in the $(i-1)^{th}$ stage of gamma amplification circuit.

As described above, according to the present embodiments, it is possible to provide a source driver integrated circuit and a gamma reference voltage generator, which can improve the image quality by preventing or reducing the wavy noise phenomenon, i.e. display of a pattern of stripe-shaped transverse lines on the screen.

In addition, according to the present embodiments, it is possible to provide a source driver integrated circuit and a gamma reference voltage generator, which can improve the image quality by preventing or reducing the wavy noise phenomenon through offset control of a gamma amplifier.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION

Figure 1:
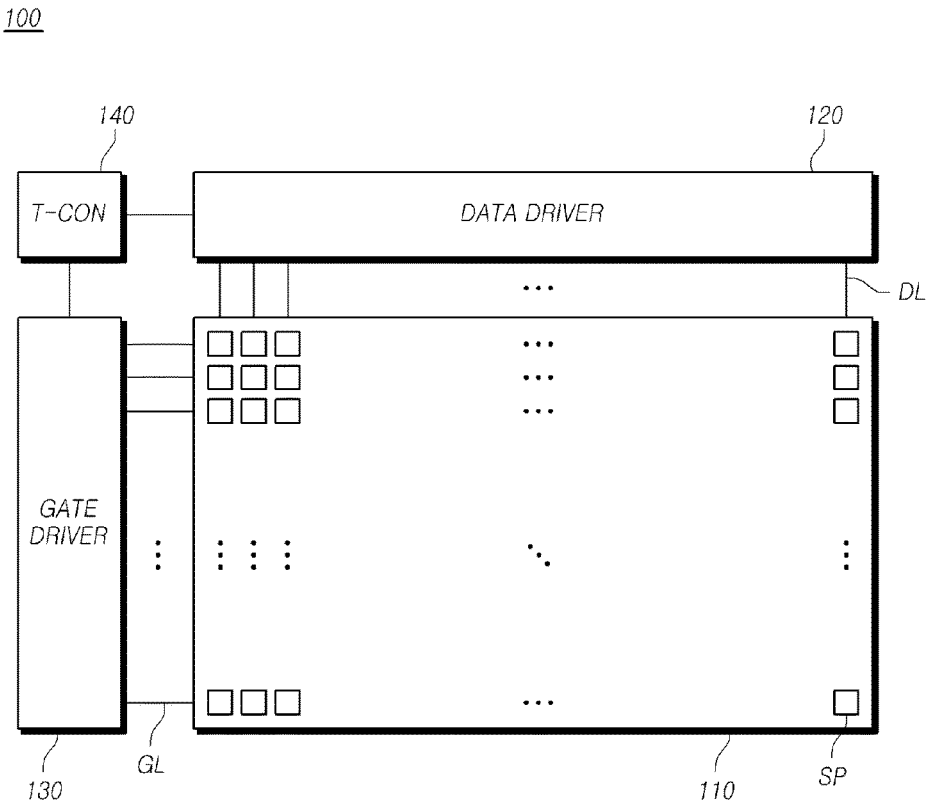
FIG. 1 is a diagram illustrating a system construction of a display device according to the present embodiments.

Hereinafter, embodiments of the present invention will be described in detail with reference to the accompanying drawings. In adding reference numerals to elements in each drawing, the same elements will be designated by the same reference numerals, if possible, although they are shown in different drawings. Further, in the following description of the present invention, a detailed description of known functions and configurations incorporated herein will be omitted when it is determined that the description may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 is a diagram illustrating a system construction of a display device 100 according to the present embodiments.

Referring to FIG. 1, the display device 100 according to the present embodiments include a display panel 110, which has multiple data lines DL and multiple gate lines GL arranged thereon, and which has multiple sub-pixels SP arranged in a matrix type; a data driving unit 120, which drives the multiple data lines DL; a gate driving unit 130, which drives the multiple gate lines GL; and a timing controller 140, which controls the data driving unit 120 and the gate driving unit 130.

The data driving unit 120 supplies the multiple data lines DL with a data voltage, thereby driving the multiple data lines.

The gate driving unit 130 successively supplies the multiple gate lines GL with a scan signal (gate signal), thereby successively driving the multiple gate lines GL.

The timing controller 140 supplies the data driving unit 120 and the gate driving unit 130 with various control signals, thereby controlling the data driving unit 120 and the gate driving unit 130.

The timing controller 140 starts a scan according to timing implemented in each frame, converts input image data, which is input from the outside the display device, so as conform to a data signal format used by the data driving unit 120, outputs the converted image data, and restricts data driving at a suitable time in conformity with the scan.

The gate driving unit 130 successively supplies the multiple gate lines with a scan signal of an on-voltage or off-voltage, under the control of the timing controller 140, thereby successively driving the multiple gate lines.

The gate driving unit 130 may be positioned only on one side of the display panel 110, as in the case of FIG. 1, or, in some cases, on either side thereof, according to the driving scheme.

In addition, the gate driving unit 130 may include one or more gate driver integrated circuits (GDIC).

Each gate driver integrated circuit may include a shift register, a level shifter, and the like.

When a specific gate line is opened, the data driving unit 120 converts digital image data, which has been received from the timing controller 140, to an analog-type data voltage (analog voltage) and supplies multiple data lines with the same, thereby driving the multiple data lines.

The data driving unit 120 may include at least one source driver integrated circuit (SDIC), thereby driving multiple data lines.

Each source driver integrated circuit may include a logic unit, which includes a shift register, a latch circuit, and the like, a digital analog converter (DAC), an output buffer, and the like, and may further include, in some cases, a sensing unit (sensor) for sensing the characteristics of a sub-pixel, in order to compensate for the characteristics of the sub-pixel (for example, the threshold voltage of a driving transistor, the mobility thereof, the threshold voltage of an organic light-emitting diode, the luminance of a sub-pixel, and the like).

The display device 100 according to the present embodiments may be, for example, one selected from a liquid crystal display, a plasma display device, an organic light-emitting display device, and the like.

Each of multiple sub-pixels, which are arranged on the display panel 110 of such a display device 100, may have circuit elements arranged thereon, such as a transistor, a capacitor, and the like.

For example, when the display panel 110 is an organic light-emitting display panel, each sub-pixel may include circuit elements such as an organic light-emitting diode (OLED), two or more transistors, at least one capacitor, and the like.

The kind and number of circuit elements, which constitute each sub-pixel, may be variously determined according to functions to be provided, design schemes, and the like.

Figure 2:
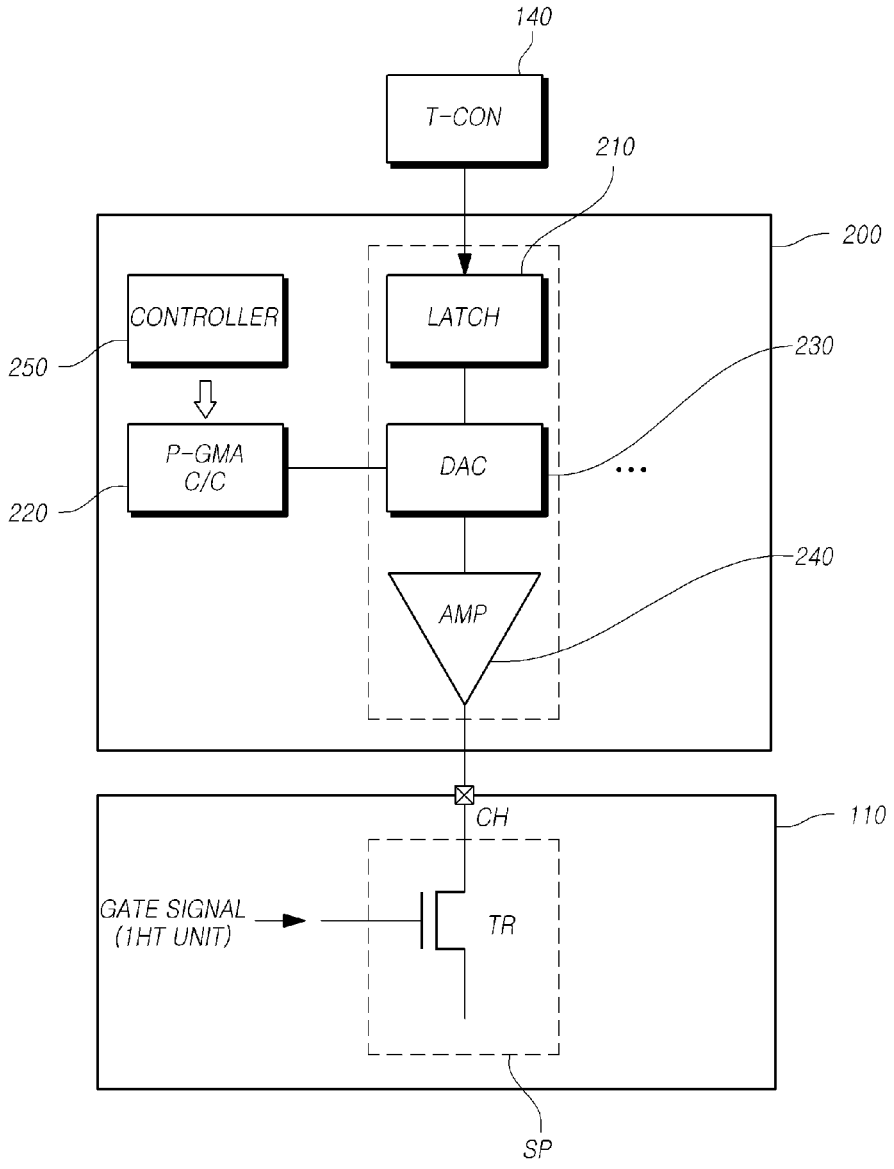
FIG. 2 is a diagram schematically illustrating a source driver integrated circuit according to the present embodiments.

FIG. 2 is a diagram schematically illustrating a source driver integrated circuit 200 according to the present embodiments.

Referring to FIG. 2, the source driver integrated circuit 200 according to the present embodiments includes a latch circuit 210 configured to store digital image data and to output the same; a digital analog converter (DAC) 230 configured to convert the digital image data, which has been output from the latch circuit 210, to an analog voltage and to output the same; and an output buffer 240 configured to amplify the analog voltage, which has been converted by the digital analog converter 230, and to output the same to a corresponding channel CH.

Referring to FIG. 2, in order to generate a gamma reference voltage necessary for the conversion function of the digital analog converter 230, a programmable-gamma circuit (P-GMA C/C) 220 is needed.

Such a programmable-gamma circuit 220 may be embedded in the source driver integrated circuit 200 as illustrated in FIG. 2. In some cases, the programmable-gamma circuit 220 may be included outside the source driver integrated circuit 200. Such a case will be described again with reference to FIG. 11.

On the other hand, referring to FIG. 2, the source driver integrated circuit 200 according to the present embodiments may further include a control unit 250 capable of controlling the programmable-gamma circuit 220.

FIG. 2 schematically illustrates a structure with regard to only one channel CH; in the case of multiple channels, latch circuits 210, digital analog converters 230, output buffers 240, and the like may be additionally included as many as the number of channels.

Referring to FIG. 2, the analog voltage, which has been output from the output buffer 240, may be supplied to a transistor TR inside a sub-pixel SP, which is electrically connected to the corresponding channel CH.

Figure 3:
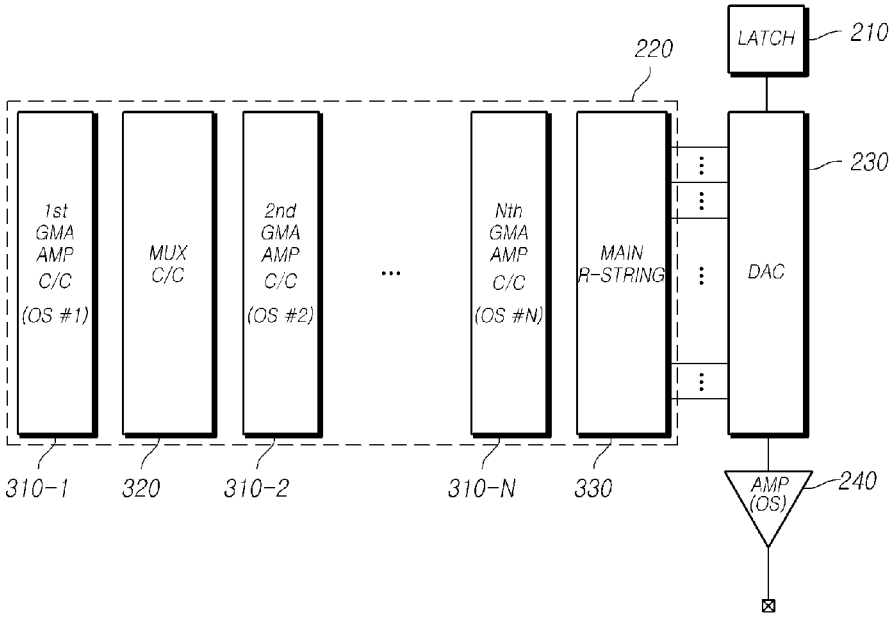
FIG. 3 is a diagram illustrating a schematic configuration of a programmable-gamma circuit according to the present embodiments.

FIG. 3 is a diagram illustrating a schematic configuration of a programmable-gamma circuit 220 according to the present embodiments.

Referring to FIG. 3, the programmable-gamma circuit 220 is configured to generate a gamma reference voltage and to output the same to a digital analog converter 230, and includes N stages of gamma amplification circuits ($1^{st}$ GMA AMP C/C 310-1, $2^{nd}$ GMA AMP C/C 310-2, . . . $N^{th}$ GMA AMP C/C 310-N, N≥2), multiplexer circuits (MUX C/C) 320 arranged between respective stages of gamma amplification circuits, a main resistor-string (R-String) 330 connected to the $N^{th}$ gamma amplification circuit ($N^{th}$ GMA AMP C/C) 310-N, and the like.

The N stages of gamma amplification circuits 310-1, 310-2, . . . 310-N may also be referred to as N stages of gamma amplifier groups.

Each of the N stages of gamma amplification circuits 310-1, 310-2, . . . 310-N, i.e. each of the N stages of gamma amplifier groups, includes at least one gamma amplifier.

Accordingly, the programmable-gamma circuit 220, as a whole, includes a plurality of gamma amplifiers.

In addition, the plurality of gamma amplifiers are grouped into N gamma amplifier groups (N is a natural number equal to or larger than 2). Furthermore, N gamma amplifier groups become N stages of gamma amplifier groups. Each multiplexer circuit (MUX C/C) 320 may include a gamma resistor string, a multiplexer (or decoder), and the like.

On the other hand, referring to FIG. 3, each stage of gamma amplifier group of the programmable-gamma circuit 220 has a group-wise offset OS #i (i=1, 2, . . . N; i refers to the stage number of the gamma amplifier group). Accordingly, the output buffer 240 has a final offset (OS=OS #1+OS #2+ . . . +OS #N) corresponding to a combination of the offset (OS #i) of each stage of gamma amplifier group.

For example, when two (i.e. N=2) stages of gamma amplifier groups are arranged in the programmable-gamma circuit 220, the output buffer 240 has a final offset (OS) corresponding to a combination of the offset (OS #1) of the first stage of gamma amplifier group and the offset (OS #2) of the second stage of gamma amplifier group.

On the other hand, the control unit 250 can control the offset of each stage of gamma amplifier group.

The offset of a gamma amplifier is a voltage component corresponding to an error, which may naturally occur during gamma amplification, and acts as a factor that degrades the gamma amplification performance.

Offsets of respective gamma amplifiers, which are included in each stage of gamma amplifier group, are error components and therefore may be either identical to each other or different from each other.

However, it will be assumed in the following description, for convenience in conceptual description of offset control, that respective offsets of all gamma amplifiers included in each stage of gamma amplifier group are identical to each other.

The offset of each stage of gamma amplifier group may be, for example, the largest offset among offsets of respective gamma amplifiers included in each stage of gamma amplifier group, or may be a value corresponding to the average of offsets of respective gamma amplifiers included in each stage of gamma amplifier group.

In the present embodiments, the offset of each gamma amplifier, which occurs naturally, may have previously been set as design information regarding each gamma amplifier.

According to the offset control of the present embodiments, the signal output timing of gamma amplifiers is controlled with regard to each stage of gamma amplifier group such that offsets of respective stages of gamma amplifier groups do not have the same phase, thereby increasing the possibility that the deviation related to final offsets among analog voltages, which are output from the final output stage of the source driver integrated circuit, can be minimized to the largest extent.

That is, the offset of each stage of gamma amplifier group may be reflected as the final offset in the analog voltage output from the amplifier that corresponds to the output buffer 240.

For example, when offsets of respective stages of gamma amplifier groups have the same phase, the offsets of respective stages of gamma amplifier groups overlap, and the overlapped offsets are reflected as the final offset in the analog voltage, which is to be output from the amplifier that corresponds to the output buffer 240. That is, the final offset of the amplifier, which corresponds to the output buffer 240, corresponds to an error component of the analog voltage output from the output buffer 240.

Accordingly, the output buffer 240 outputs an analog voltage having a final offset, which corresponds to an error component, added thereto. As a result, undesired screen images may be displayed.

The above-mentioned control unit 250 can control offsets with regard to respective stages of gamma amplification circuits 310-1, 310-2, . . . , 310-N, i.e. with regard to respective gamma amplifier groups.

For example, the control unit 250 may control the offset of at least one gamma amplifier, which is included in a gamma amplifier group corresponding to the first stage of gamma amplification circuit 310-1, and the offset of at least one gamma amplifier, which is included in a gamma amplifier group corresponding to the second stage of gamma amplifier circuit 310-2, to be different from each other, and may control respective offsets of a plurality of gamma amplifiers, which are included in respective stages of gamma amplification circuits 310-1, 310-2, . . . , 310-N to be identical to each other. In the present embodiments, the control unit 250 may output an offset control signal to gamma amplifiers included in respective stages of gamma amplifier groups such that offsets of respective stages of gamma amplifier groups do not completely overlap each other.

That is, the control unit 250 may provide respective stages of gamma amplifier groups with different offset control signals, thereby controlling the offsets of respective stages of gamma amplifier groups.

As used herein, the offset control signal refers to a control signal, which is provided by the control unit 250 to each stage of gamma amplifier group arranged in the programmable-gamma circuit 220, in order to control the offset of each stage of gamma amplifier group.

In this connection, complete overlapping of offsets of respective stages of gamma amplifier groups means that offsets of respective stages of gamma amplifier groups change to high and low levels at the same timing, and the length of the high level intervals and that of the low level intervals are identical. In other words, complete overlapping of offsets of respective stages of gamma amplifier groups means that offsets of respective stages of gamma amplifier groups have the same waveform in terms of timing according to one embodiment.

In contrast, incomplete overlapping of offsets of respective stages of gamma amplifier groups means that, even though the length of high level intervals and that of low lever intervals are identical, offsets of respective stages of gamma amplifier groups do not change to high and low levels at the same timing according to one embodiment.

Particularly, when offsets of respective stages of gamma amplifier groups do not completely overlap, the offset of one stage of gamma amplifier group, which is arranged in the programmable-gamma circuit 220, is delayed by a predetermined time length (for example, an integer multiple of 1 HT) compared with the offset of another stage of gamma amplifier group.

For the purpose of such offset control according to the present embodiments, the control unit 250 may conduct a control such that the offset OS #i of the $i^{th}$ stage (i=2, . . . , N) of gamma amplifier group is delayed by a predetermined time length compared with the offset OS #i−1 of the $(i-1)^{th}$ stage of gamma amplifier group.

Hereinafter, offset control according to the present embodiments will be described in more detail with reference to FIG. 4 to FIG. 9 in connection with an exemplary programmable-gamma circuit 200 including two stages of gamma amplifier groups.

Figure 4:
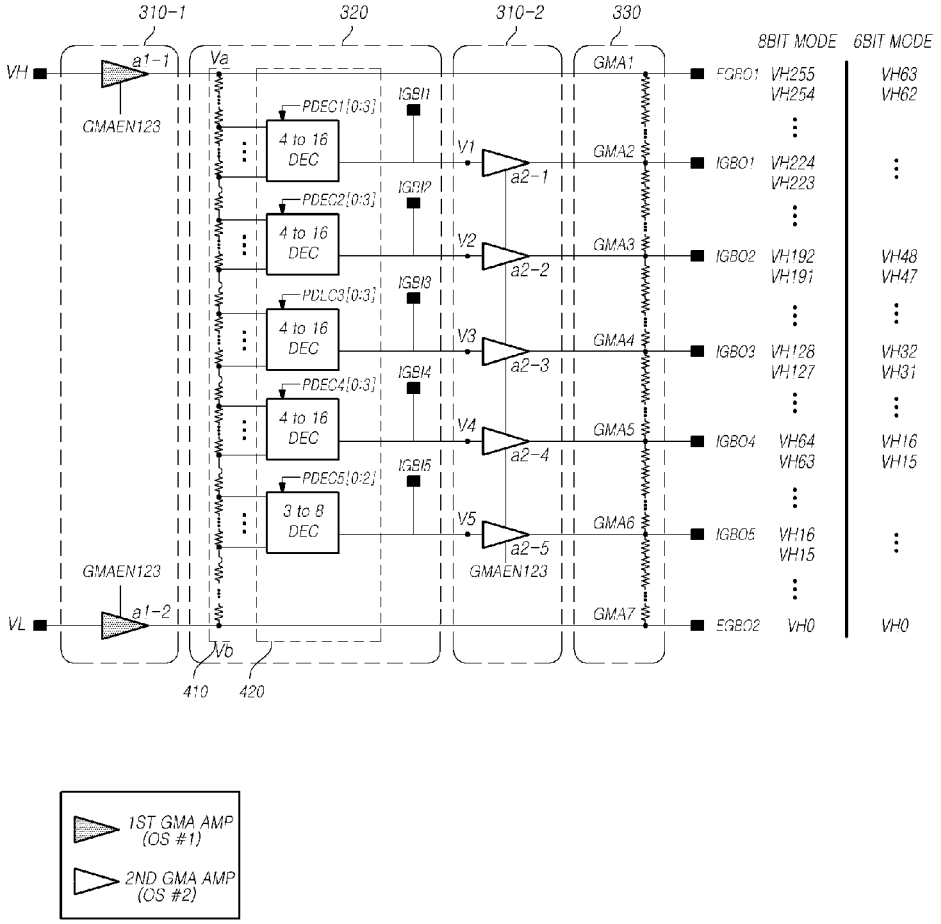
FIG. 4 is an exemplary diagram illustrating a programmable-gamma circuit according to the present embodiments.
Figure 5:
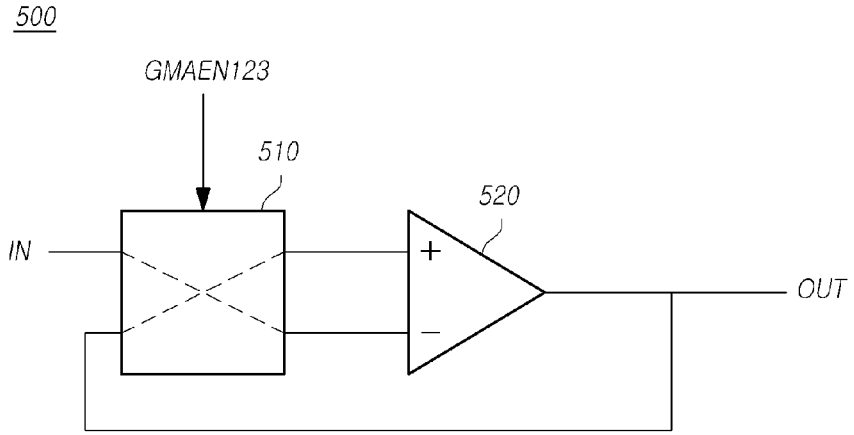
FIG. 5 is a diagram illustrating an exemplary configuration of a gamma amplifier of a programmable-gamma circuit according to the present embodiments.
Figure 6:
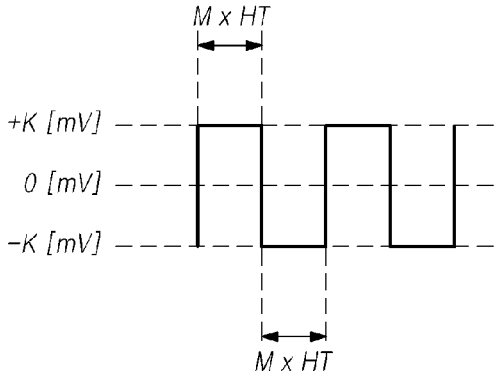
FIG. 6 is a diagram illustrating an offset of each stage of gamma amplifier group of a programmable-gamma circuit according to the present embodiments.

FIG. 4 is an exemplary diagram illustrating a programmable-gamma circuit 220 according to the present embodiments. FIG. 5 is a diagram illustrating an exemplary configuration of a gamma amplifier of a programmable-gamma circuit 220 according to the present embodiments. FIG. 6 is a diagram illustrating an offset of each stage of gamma amplifier group of a programmable-gamma circuit 220 according to the present embodiments.

Referring to FIG. 4, the programmable-gamma circuit 220 according to the present embodiments may include two stages of gamma amplification circuits 310-1 and 310-2, a multiplexer circuit 320 arranged between the two stages of gamma amplification circuits 310-1 and 310-2, a main resistor string 330, which is connected to a digital analog converter 230, and which is configured to adjust the gradation (which may be the liquid crystal transmittance in the case of a liquid crystal display device) of a corresponding sub-pixel of a display panel 110, and the like.

The first-stage gamma amplification circuit 310-1 is, for example, a first stage of gamma amplifier group including two first-stage gamma amplifiers ($1^{st}$ GMA AMP) a1-1 and a1-2.

The second-stage gamma amplification circuit 310-2 is, for example, a second stage of gamma amplifier group including five second-stage gamma amplifiers ($2^{nd}$ GMA AMP) a2-1, a2-2, a2-3, a2-4, and a2-5.

Multiple tabs are connected to the main resistor string 330 for the purpose of voltage distribution, and a gamma reference voltage is supplied to the digital analog converter 230 via the multiple tabs.

For example, in the case of an eight-bit mode, the programmable-gamma circuit 220 generates 256 sets of gamma reference voltages VH0-VH255 for the purpose of gradation to be implemented and, in the case of a six-bit mode, generates 64 sets of gamma reference voltages VH0-VH63 for the purpose of gradation to be implemented, and then supplies the same.

The multiplexer circuit 320, which is arranged between the two stages of gamma amplification circuits 310-1 and 310-2, includes a gamma resistor string 410, multiple multiplexers 420 (which may be decoders), and the like.

The first-stage gamma amplification circuit 310-1 receives two input voltages VH and VL from a power management integrated circuit (PMIC), which is included in the display device 100.

In the first-stage gamma amplification circuit 310-1, the first-stage gamma amplifier a1-1 amplifies the high voltage VH, between the two input voltages, and outputs the same; and the first-stage gamma amplifier a1-2 amplifies the low voltage VL, between the two input voltages, and outputs the same.

The voltage Va output from the first-stage gamma amplifier a1-1 and the voltage Vb output from the first-stage gamma amplifier a1-2 are applied to one end and the other end of the gamma resistor string 410, which is included in the multiplexer circuit 320, respectively.

The multiple multiplexers 420, which are included in the multiplexer circuit 320, are connected to intermediate points of the gamma resistor string 410, the Va voltage being applied to one end thereof, and the Vb voltage being applied to the other end thereof, respectively, and decode respective voltages of the connected intermediate points and output the same.

Voltages V1, V2, V3, V4, and V5, which are output by the multiple multiplexers 420, are voltages set by decoding setting values.

The five second-stage gamma amplifiers a2-1, a2-2, a2-3, a2-4, and a2-5, which are included in the second-stage gamma amplification circuit 310-2, receive the voltages V1, V2, V3, V4, and V5, which are output from the multiple multiplexers 420, respectively, and amplify and output the same.

Voltages Va and Vb are applied to both ends of the main resistor string 330, respectively, and voltages GMA2, GMA3, GMA4, GMA5, and GMA6, which are output from the second-stage gamma amplification circuit 310-2, are applied to respective intermediate points. In this case, according to circuit design change and the like, the voltage output from the gamma amplifier a2-1 and the voltage output from the gamma amplifier a2-5, among voltages output from the second-stage gamma amplification circuit 310-2, may be applied to both ends of the main resistor string 330, respectively.

After voltage Va (=GMA1) and voltage Vb (=GMA7) are applied to both ends of the main resistor string 330, respectively, and voltages GMA2, GMA3, GMA4, GMA5, and GMA6, which are output from the second-stage gamma amplification circuit 310-2, are applied to respective intermediate points, a gamma reference voltage is supplied to the digital analog converter 230 via the multiple tabs.

Referring to FIG. 5, the gamma amplifier 500 may include a switching unit 510 and an amp unit 520.

The switching unit 510 selectively connects an input voltage IN and an output voltage OUT of the amp unit 520 to the plus (+) input terminal of the amp unit 520 or to the minus (−) input terminal thereof according to an offset control signal GMAEN123.

When the offset control signal GMAEN123 is logic high, for example, the amp unit 520 may input the input voltage IN to the plus (+) input terminal and may input the output voltage OUT to the minus (−) input terminal, thereby having a plus (+) offset. In addition, when the offset control signal GMAEN123 is logic low, for example, the amp unit 520 may input the output voltage OUT to the plus (+) input terminal and may input the input voltage IN to the minus (−) input terminal, thereby having a minus (−) offset.

Such a gamma amplifier 500 may be applied to the plurality of gamma amplifiers a1-1, a1-2, a2-1, a2-2, a2-3, a2-4, and a2-5 illustrated in FIG. 4.

Referring to FIG. 6, the offset of each of the plurality of gamma amplifiers a1-1, a1-2, a2-1, a2-2, a2-3, a2-4, and a2-5 may have such a shape that, according to the offset control signal GMAEN123, a high level and a low level alternate with each other by M (M is a natural number equal to or larger than 2)×horizontal time HT. In this regard, the horizontal time HT corresponds to a time taken to drive one line (gate line) of the display panel 110, and may be abbreviated to "H".

The high level corresponds to +K [mV] voltage level, and the low level corresponds to −K [mV] voltage level. In this case, +K and −K [mV] correspond to arbitrary voltage values.

All gamma amplifiers a1-1 and a1-2 included in the first stage of gamma amplifier group may have the same offset OS #1.

The offset OS #1 of each of all gamma amplifiers a1-1 and a1-2 included in the first stage of gamma amplifier group may have a high level, which corresponds to +K [mV] voltage level, and a low level, which corresponds to −K [mV] voltage level, alternating with each other.

All gamma amplifiers a2-1, a2-2, a2-3, a2-4, and a2-5 included in the second stage of gamma amplifier group may have the same offset OS #2.

The offset OS #2 of each of all gamma amplifiers a2-1, a2-2, a2-3, a2-4, and a2-5 included in the second stage of gamma amplifier group may also have a high level, which corresponds to +K [mV] voltage level, and a low level, which corresponds to −K [mV] voltage level, alternating with each other.

As described above, the control unit 250 can control the offset OS #1 of each of all gamma amplifiers a1-1 and a1-2 included in the first stage of gamma amplifier group and the offset OS #2 of each of gamma amplifiers a2-1, a2-2, a2-3, a2-4, and a2-5 included in the second stage of gamma amplifier group.

That is, the control unit 250 supplies an offset control signal GMAEN123 to each of all gamma amplifiers a1-1 and a1-2 included in the first stage of gamma amplifier group and supplies an offset control signal GMAEN123 to each of all gamma amplifiers a2-1, a2-2, a2-3, a2-4, and a2-5 included in the second stage of gamma amplifier group.

Figure 9:
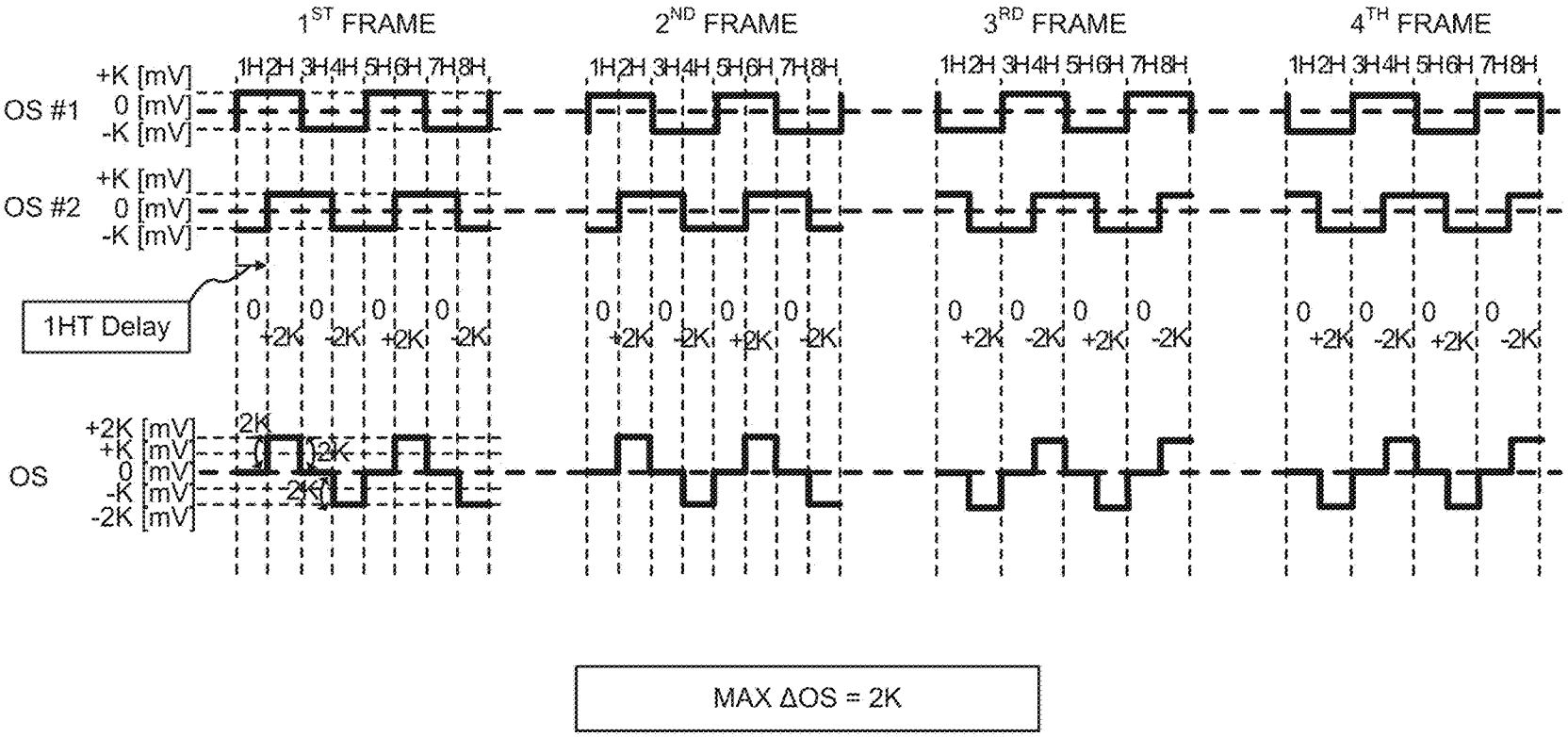
FIG. 9 is a diagram illustrating, assuming that a programmable-gamma circuit according to the present embodiments includes two stages of gamma amplifier groups, and that offset control is applied, the offset of the first stage of gamma amplifier group, the offset of the second stage of gamma amplifier group, and the final offset of the output buffer.

According to offset control according to the present embodiments, the control unit 250 does not conduct a control such that offsets of respective stages of gamma amplifier groups completely overlap with each other (FIG. 7), but conducts a control such that offsets of respective stages of gamma amplifier groups do not completely overlap with each other (FIG. 9).

Such offset control according to the present embodiments can substantially reduce the degree of change of the final offset of an amplifier, which corresponds to the output buffer 240 inside the source driver integrated circuit 200, i.e. the final offset deviation. Such a reduction in offset deviation can improve the image quality.

Hereinafter, offset control according to the present embodiments and advantageous effects resulting from the same will be described with reference to FIG. 7 to FIG. 10.

Firstly, complete overlapping of offsets of respective stages of gamma amplifier groups, when offset control according to the present embodiments is not applied, and degradation of image quality resulting from the same, will be described with reference to FIG. 7 and FIG. 8.

Figure 7:
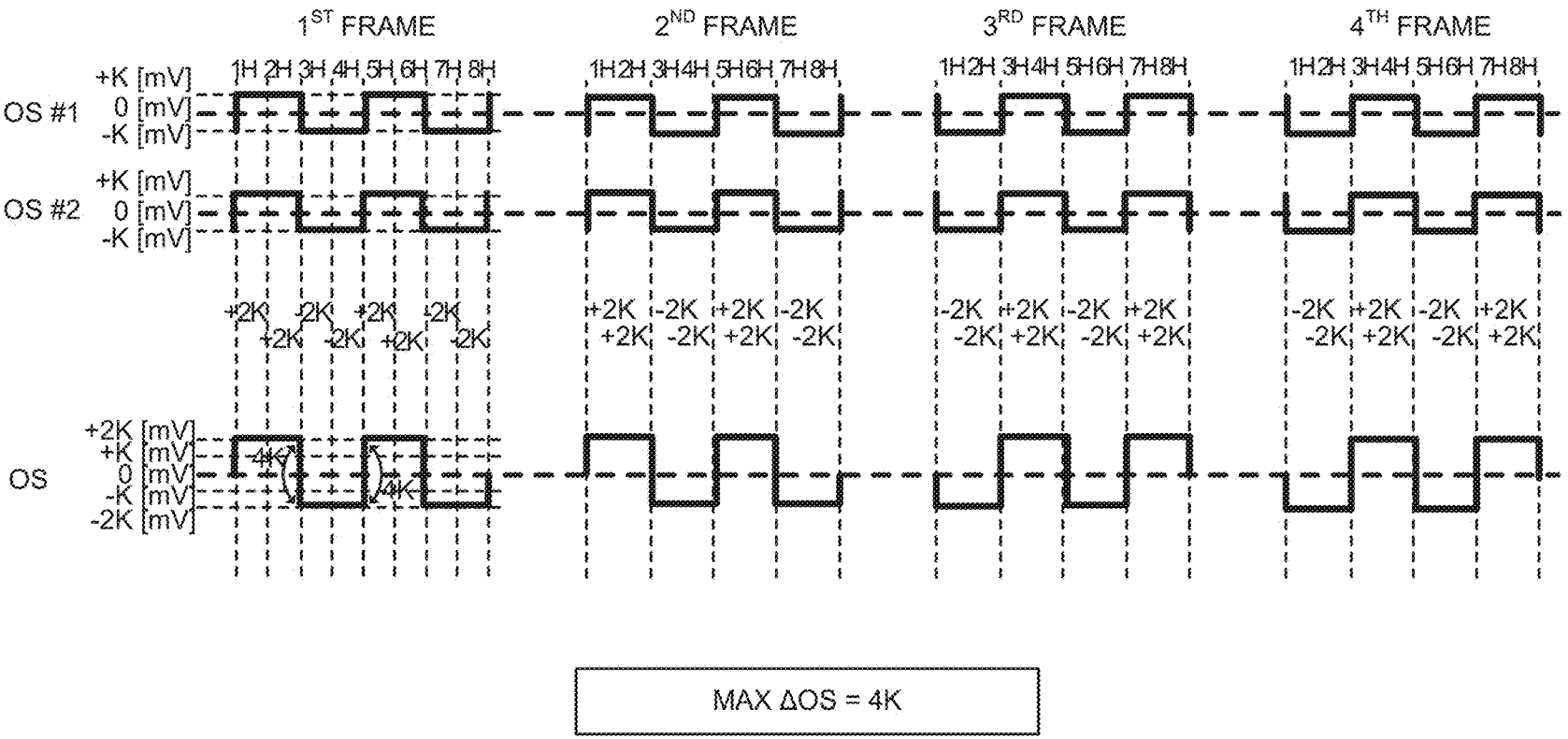
FIG. 7 is a diagram illustrating, assuming that a programmable-gamma circuit according to the present embodiments includes two stages of gamma amplifier groups, and that offset control is not applied, the offsets of the first stage of gamma amplifier group and of the second stage of gamma amplifier group, respectively, and the final offset of the output buffer.

FIG. 7 illustrates, assuming that the programmable-gamma circuit 220 according to the present embodiments includes two stages of gamma amplifier groups, and that offset control is not applied, the offsets OS #1 and OS #2 of all gamma amplifiers a1-1 and a1-2 included in the first stage of gamma amplifier group and of all gamma amplifiers a2-1, a2-2, a2-3, a2-4, and a2-5 included in the second stage of gamma amplifier group, respectively, and the final offset OS of the output buffer 240. FIG. 8 illustrates a screen on which wavy noise occurs when offset control according to the present embodiments is not applied.

Referring to FIG. 7, the offset OS #1 of all gamma amplifiers a1-1 and a1-2 included in the first stage of gamma amplifier group has such a shape that +KmV (high level voltage) is maintained during 2 HT (when M=2), and −KmV (low level voltage) is then maintained during 2 HT.

Similarly, the offset OS #2 of all gamma amplifiers a2-1, a2-2, a2-3, a2-4, and a2-5 included in the second stage of gamma amplifier group has such a shape that +KmV (high level voltage) is maintained during 2 HT (when M=2), and −KmV (low level voltage) is then maintained during 2 HT.

Referring to FIG. 7, the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group change their levels at the same points of time. That is, the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group completely overlap each other.

Therefore, the final offset OS of the amplifier of the output buffer 240 has a repetition of a high level (+2 KmV), which is the sum of the high level voltage (+KmV) of the offset OS #1 of all gamma amplifiers a1-1 and a1-2 included in the first stage of gamma amplifier group and the high level voltage (+KmV) of the offset OS #2 of all gamma amplifiers a2-1, a2-2, a2-3, a2-4, and a2-5 included in the second stage of gamma amplifier group, and of a low level (−2 KmV), which is the sum of the low level voltage (−KmV) of the offset OS #1 of all gamma amplifiers a1-1 and a1-2 included in the first stage of gamma amplifier group and the low level voltage (−KmV) of the offset OS #2 of all gamma amplifiers a2-1, a2-2, a2-3, a2-4, and a2-5 included in the second stage of gamma amplifier group.

That is, the final offset OS of the amplifier of the output buffer 240 has the following repetition, during each HT: +2 KmV, +2 KmV, −2 KmV, −2 KmV, +2 KmV, +2 KmV, −2 KmV, −2 KmV, . . . .

Accordingly, the largest deviation ΔOS of the final offset OS of the amplifier of the output buffer 240 becomes 4 KmV (=+2K−(−2K)).

Considering the offset OS #1 of all gamma amplifiers a1-1 and a1-2 included in the first stage of gamma amplifier group and the offset OS #2 of all gamma amplifiers a2-1, a2-2, a2-3, a2-4, and a2-5 included in the second stage of gamma amplifier group, the deviation ΔOS of the final offset OS of the amplifier of the output buffer 240 has a maximum value MAX.

Figure 8:
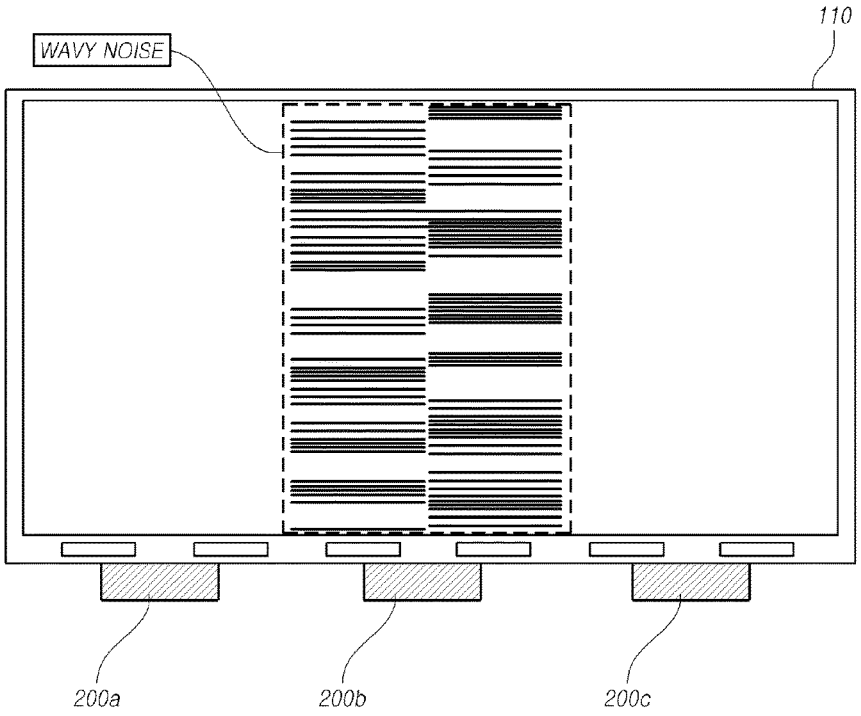
FIG. 8 is a diagram illustrating a screen on which wavy noise occurs when offset control according to the present embodiments is not applied.

Referring to FIG. 8, the display device 100 may include three source driver integrated circuits 200*a*, 200*b*, and 200*c*, for example, and, when complete offset overlapping occurs in the programmable-gamma circuit 220 inside the second source driver integrated circuit 200*b* among the three source driver integrated circuits 200*a*, 200*b*, and 200*c*, the deviation ΔOS related to the final offset OS occurring in the output buffer 240 of the second source driver integrated circuit 200*b* has a maximum value MAX.

Therefore, the screen area, in which sub-pixels that receive a data voltage through the second source driver integrated circuit 200*b*, has a large difference between an image driving voltage occurring when the final offset OS occurring in the amplifier of the output buffer 240 of the second source driver integrated circuit 200*b* is largest (+2

KmV) and another image driving voltage occurring when the same is smallest (−2 KmV).

That is, referring to FIG. 7, the final offset OS varies greatly with regard to every 2 HT (+2K→+2K→−2K→−2K→+2K→+2K→−2K→−2K→ . . . ), and the image driving voltage also varies greatly with regard to every 2 HT.

As a result, the brightness varies greatly with regard to every two lines in the corresponding screen area, as illustrated in FIG. 8, and, as a result of this phenomenon, the user comes to notice a pattern of repeated transverse stripe-type lines. Such a phenomenon is referred to as "wavy noise". Such wavy noise may substantially degrade the image quality.

The source driving integrated circuit 200 according to the present embodiments can provide offset control in order to prevent degradation of image quality resulting from such wavy noise.

Hereinafter, offset control according to the present embodiments, which is for the purpose of preventing degradation of image quality resulting from wavy noise, will be described with reference to FIG. 9 and FIG. 10.

FIG. 9 illustrates, assuming that the programmable-gamma circuit 220 according to the present embodiments includes two stages of gamma amplifier groups, and that offset control is applied, the offsets OS #1 of all gamma amplifiers a1-1 and a1-2 included in the first stage of gamma amplifier group, the offset OS #2 of all gamma amplifiers a2-1, a2-2, a2-3, a2-4, and a2-5 included in the second stage of gamma amplifier group, and the final offset OS of the output buffer 240. FIG. 10 illustrates a screen on which occurrence of wavy noise is prevented, when offset control according to the present embodiments is applied.

Referring to FIG. 9, the offset OS #1 of each of all gamma amplifiers a1-1 and a1-2 included in the first stage of gamma amplifier group has such a shape that +KmV (high level voltage) is maintained during 2 HT (when M=2), and −KmV (low level voltage) is then maintained during 2 HT.

Similarly, the offset OS #2 of each of all gamma amplifiers a2-1, a2-2, a2-3, a2-4, and a2-5 included in the second stage of gamma amplifier group has such a shape that +KmV (high level voltage) is maintained during 2 HT (when M=2), and −KmV (low level voltage) is then maintained during 2 HT.

Referring to FIG. 9, the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group do not change their levels at the same points of time, but change their levels at different points of time. That is, the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group do not completely overlap each other.

To describe it differently, when offset control according to the present embodiments is applied, the offset OS #2 of each of all gamma amplifiers (in the case of FIGS. 4, a2-1, a2-2, a2-3, a2-4, and a2-5) included in the $i^{th}$ stage of gamma amplifier group may be delayed by an integer multiple of one horizontal time 1 HT than the offset OS #1 of each of all gamma amplifiers (in the case of FIG. 4, a1-1 and a1-2) included in the $(i-1)^{th}$ stage of gamma amplifier group.

To this end, the control unit 250 outputs an offset control signal GMAEN123, which is supplied to each of all gamma amplifiers a2-1, a2-2, a2-3, a2-4, and a2-5 included in the $i^{th}$ stage of gamma amplifier group, and an offset control signal GMAEN123, which is supplied to each of all gamma amplifiers a1-1 and a1-2 included in the $(i-1)^{th}$ stage of gamma amplifier, to be different from each other.

Accordingly, each of all gamma amplifiers a2-1, a2-2, a2-3, a2-4, and a2-5 included in the $i^{th}$ stage of gamma amplifier group delays the output timing of the output signal according to the offset control signal GMAEN123.

Therefore, the offset OS #2 of each of all gamma amplifiers a2-1, a2-2, a2-3, a2-4, and a2-5 included in the $i^{th}$ stage of gamma amplifier group may be delayed by one horizontal time 1 HT than the offset OS #1 of each of all gamma amplifiers a1-1 and a1-2 included in the $(i-1)^{th}$ stage of gamma amplifier group.

Referring to FIG. 9, by means of 1 HT delay resulting from offset control according to the present embodiments, the offset OS #2 of each of all gamma amplifiers a2-1, a2-2, a2-3, a2-4, and a2-5 included in the second stage of gamma amplifier group changes to a high level after 1 HT starting from the point of time at which the offset OS #1 of each of all gamma amplifiers a1-1 and a1-2 included in the first stage of gamma amplifier group changes to a high level.

Similarly, the offset OS #2 of each of all gamma amplifiers a2-1, a2-2, a2-3, a2-4, and a2-5 included in the second stage of gamma amplifier group changes to a low level after 1 HT starting from the point of time at which the offset OS #1 of each of all gamma amplifiers a1-1 and a1-2 included in the first stage of gamma amplifier group changes to a low level.

As a result of the above-mentioned type of control of the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group, the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group may not have the same voltage level.

More particularly, when both the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group have a high level (+KmV), the final offset OS of the amplifier of the output buffer 240 becomes +2 KmV.

In addition, when both the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group have a low level (−KmV), the final offset OS of the amplifier of the output buffer 240 becomes −2 KmV.

However, when one OS #1 or OS #2 of the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group has a high level (+KmV), while the other OS #2 or OS #1 has a low level (−KmV), the final offset OS of the amplifier of the output buffer 240 becomes 0 mV.

Therefore, the final offset OS of the amplifier of the output buffer 240, which occurs as a combination of the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group, changes, with regard to every 1 HT in each frame, in the following manner: 0, +2K, 0, −2K, 0, +2K, 0, −2K, . . . .

Accordingly, the largest deviation ΔOS of the final offset OS of the amplifier of the output buffer 240 becomes 2 KmV (=+2K−(0) or 0−(−2K)).

When offset control according to the present embodiments is conducted as in FIG. 9, the largest deviation ΔOS of the final offset OS of the amplifier of the output buffer 240 is reduced by half from 4 KmV to 2 KmV, compared with the case in which offset control according to the present embodiments is not conducted, as in FIG. 7.

For example, when each of the offset OS #1 of each of all gamma amplifiers a1-1 and a1-2 included in the first stage of gamma amplifier group and the offset OS #2 of each of all gamma amplifiers a2-1, a2-2, a2-3, a2-4, and a2-5 included in the second stage of gamma amplifier group changes between −10 mV and +10 mV, i.e. when K is 10, the largest deviation ΔOS of the final offset OS of the amplifier of the output buffer 240 is 40 mV, if offset control according to the present embodiments is not conducted, but is substantially reduced to 20 mV if offset control according to the present embodiments is conducted.

Figure 10:
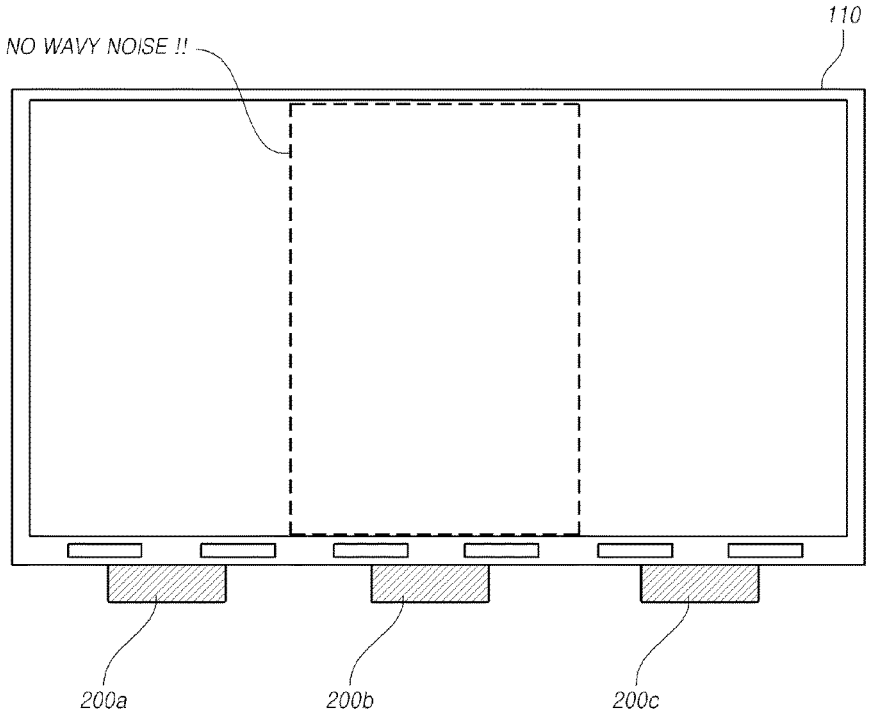
FIG. 10 is a diagram illustrating a present embodiment of a screen on which occurrence of wavy noise is prevented, when offset control according to the present embodiments is applied.

As a result, display of a pattern of transverse stripes with regard to every 2 HT, i.e. "wavy noise" phenomenon, is prevented or substantially reduced, as illustrated in FIG. 10, thereby improving the image quality.

On the other hand, the final offset OS of the output buffer 240 has at least three levels as a result of combining offsets of gamma amplifiers in respective stages.

For example, when the programmable-gamma circuit 220 includes two stages of gamma amplifiers as in FIG. 4, the final offset OS of the output buffer 240 has three levels, including 0 mV, +2 KmV, and −2 KmV.

The number of levels of the final offset OS of the output buffer 240 increases in proportion to the number of stages of gamma amplifiers included in the programmable-gamma circuit 220.

On the other hand, in connection with a plurality of gamma amplifiers included in the programmable-gamma circuit 220 inside the source driver integrated circuit 200 according to the present embodiments, the output signal of each of all gamma amplifiers included in the $i^{th}$ stage of gamma amplifier group may be delayed by an integer multiple of 1 HT than the output signal of each of all gamma amplifiers included in the $(i-1)^{th}$ stage of gamma amplifier group.

On the other hand, each of the plurality of gamma amplifiers a1-1, a1-2, a2-1, a2-2, a2-3, a2-4, and a2-5 included in the N stages of gamma amplifier groups, which are included in the programmable-gamma circuit 220 inside the source driver integrated circuit 200 according to the present embodiments, may be a differential amplifier.

In addition, the output buffer 240 included in the source driver integrated circuit 200 according to the present embodiments may also be implemented as a differential amplifier.

A structure including a programmable-gamma circuit 220, which has a plurality of gamma amplifiers grouped and arranged as two stages of gamma amplifier groups, and a method for controlling offset under such a structure have been described exemplarily with reference to FIG. 4 to FIG. 10.

However, the offset control method according to the present embodiments is not limited thereto, and can also be applied to cases in which there are three or more stages of gamma amplifiers.

Figure 11:
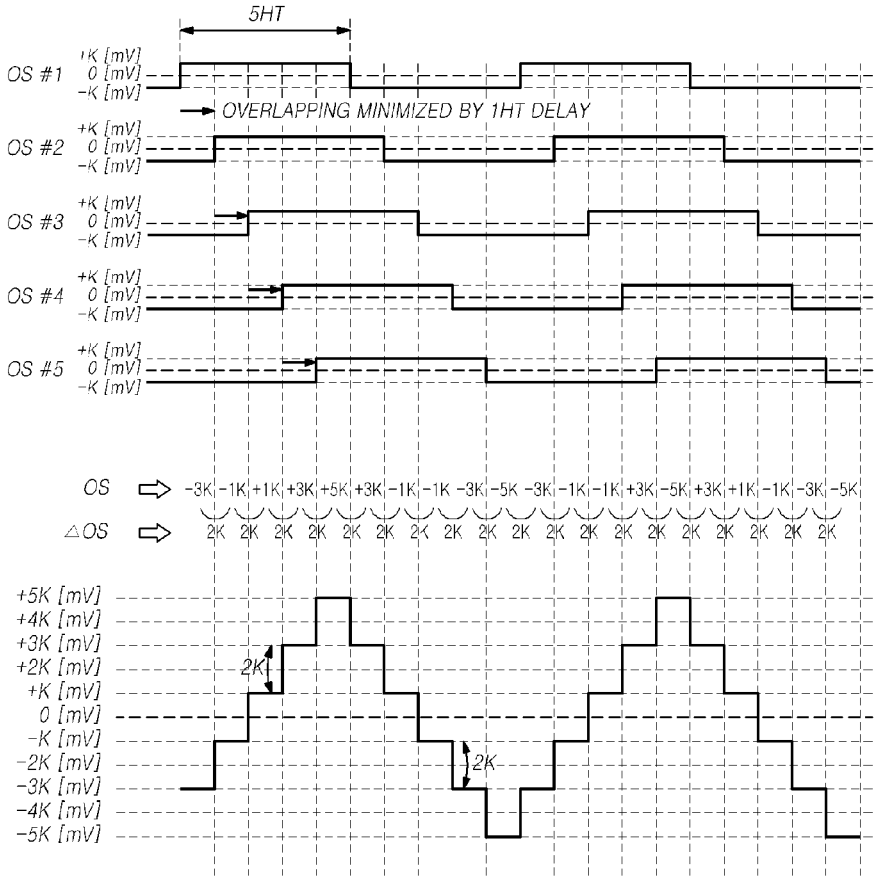
FIG. 11 is a diagram illustrating, when a programmable-gamma circuit according to the present embodiments includes five stages of gamma amplifiers, and when offset control is applied, the offsets of the first, second, third, fourth, and fifth stages of gamma amplifier groups, respectively, and the final offset of the output buffer.

FIG. 11 is a diagram illustrating, when the programmable-gamma circuit 220 according to the present embodiments includes five stages of gamma amplifiers, and when offset control is applied, the offsets OS #1, OS #2, OS #3, OS #4, and OS #5 of the first, second, third, fourth, and fifth stages of gamma amplifier groups, respectively, and the final offset OS of the output buffer 240.

Referring to FIG. 11, respective offsets OS #1, OS #2, OS #3, OS #4, and OS #5 of the first, second, third, fourth, and fifth stages of gamma amplifier groups have a high level and a low level, which are maintained during 5HT, respectively, and which alternate with each other.

However, respective offsets OS #1, OS #2, OS #3, OS #4, and OS #5 of the first, second, third, fourth, and fifth stages of gamma amplifier groups have level changing time points delayed by 1 HT, thereby minimizing the overlapping intervals of respective offsets OS #1, OS #2, OS #3, OS #4, and OS #5 of the first, second, third, fourth, and fifth stages of gamma amplifier groups.

Accordingly, the final offset OS of the output buffer 240 has the following pattern: −3K, −1K, +1K, +3K, +5K, +3K, +1K, −1K, −3K, −5K . . . .

Therefore, the deviation ΔOS of the final offset OS of the output buffer 240 becomes 2K.

If offset control is not conducted when the programmable-gamma circuit 220 includes five stages of gamma amplifier groups, the final offset OS of the output buffer 240 has the following pattern: +5K, −5K, +5K, −5K, . . . ; and the deviation ΔOS of the final offset OS of the output buffer 240 becomes 10K.

Therefore, if offset control is conducted when the programmable-gamma circuit 220 includes five stages of gamma amplifier groups, there is a 50% (5K) reduction from 10K to 5K, compared with a case of no offset control. This can reduce the degree of occurrence of wavy noise and the seriousness thereof, thereby substantially improving the image quality.

Although it has been assumed in the above description that the programmable-gamma circuit 220, which enables offset control according to the present embodiments, is embedded in the source driver integrated circuit 200, but the same could be included outside the source driver integrated circuit 200 in some cases.

As described above, according to the present embodiments, it is possible to provide a source driver integrated circuit and a gamma reference voltage generator, which can improve the image quality by preventing or reducing the wavy noise phenomenon, i.e. display of a pattern of stripe-shaped transverse lines on the screen, and a display device including the same.

In addition, according to the present embodiments, it is possible to provide a source driver integrated circuit and a gamma reference voltage generator, which can improve the image quality by preventing or reducing the wavy noise phenomenon through offset control of a gamma amplifier, and a display device including the same.

Even when all the elements constituting an embodiment of the present invention have been described above as being combined into a single unit or combined to be operated as a single unit, the present invention is not necessarily limited to such an embodiment. That is, at least two elements of all structural elements may be selectively joined and operate without departing from the scope of the present invention. Further, all structural elements may be implemented in independent hardware respectively, but some or all of the structural elements may be selectively combined and implemented in computer programs which have a program module performing functions of some elements or all elements which are combined in one or more pieces of hardware. Codes and code segments forming the computer program can be easily conceived by an ordinarily skilled person in the technical field of the present invention. Such a computer program may implement the embodiments of the present invention by being stored in a computer readable storage medium, and being read and executed by a computer. A magnetic recording medium, an optical recording medium, or the like may be employed as the storage medium of a computer program.

In addition, since terms, such as "including," "comprising," and "having" mean that one or more corresponding components may exist unless they are specifically described to the contrary, it shall be construed that one or more other components can be included. All the terms that are technical, scientific or otherwise agree with the meanings as understood by a person skilled in the art unless defined to the contrary. Common terms as found in dictionaries should be interpreted in the context of the related technical writings not too ideally or impractically unless the present invention expressly defines them so.

Although a preferred embodiment of the present invention has been described for illustrative purposes, those skilled in the art will appreciate that various modifications, additions and substitutions are possible, without departing from the scope and spirit of the invention as disclosed in the accompanying claims. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A source driver integrated circuit comprising:

a latch circuit configured to store and output digital image data;

a gamma circuit that outputs a gamma reference voltage, the gamma circuit including a plurality of gamma amplifiers comprising a first gamma amplifier and a second gamma amplifier, the first gamma amplifier receiving an input voltage and outputting a first voltage based on the input voltage, and the second gamma amplifier outputting a second voltage based on the first voltage output by the first gamma amplifier, wherein a voltage offset output by the second gamma amplifier is delayed by a time period with respect to a voltage offset output by the first gamma amplifier;

a digital analog converter configured to convert the digital image data, which has been output from the latch circuit, to an analog voltage on the basis of the gamma reference voltage and to output the analog voltage; and an output buffer configured to amplify and output the analog voltage.

2. The source driver integrated circuit of claim 1, wherein each of the plurality of gamma amplifiers has an offset having a high level and a low level alternating with each other by M (M is a natural number equal to or larger than 2)×HT (Horizontal Time).

3. The source driver integrated circuit of claim 2, wherein the offset of the first gamma amplifier is delayed by an integer multiple of 1 HT than the offset of the second gamma group.

4. The source driver integrated circuit of claim 1, wherein the output buffer has a final offset having a level generated by combining voltages output by the plurality of gamma amplifiers.

5. The source driver integrated circuit of claim 3, wherein a number of levels of a final offset of the output buffer increases in proportion to a number of the plurality of gamma amplifiers included in the gamma circuit.

6. The source driver integrated circuit of claim 1, wherein each of the plurality of gamma amplifiers is a differential amplifier.

7. The source driver integrated circuit of claim 1, wherein the output buffer is a differential amplifier.

8. The source driver integrated circuit of claim 1, wherein an output signal of each gamma amplifier is delayed by an integer multiple of 1 HT than an output signal of each gamma amplifier included in prior gamma amplifier group.

9. The source driver integrated circuit of claim 1, further comprising a control unit configured to provide respective stages of gamma amplifier groups with different offset control signals, thereby controlling offsets of respective stages of gamma amplifier groups.

10. The source driver integrated circuit of claim 1, wherein the gamma reference voltage is based on at least a combination of the first voltage output by the first gamma amplifier and the second voltage output by the second gamma amplifier.

11. The source driver integrated circuit of claim 10, wherein the combination of the first voltage and the second voltage is a sum of the first voltage and the second voltage.

12. A gamma reference voltage generator comprising:

a plurality of gamma amplification circuits arranged in N ($N \geq 2$) stages;

N−1 multiplexer circuits arranged between respective gamma amplification circuits; and a main resistor string connected to an $N^{th}$ stage of the plurality of gamma amplification circuits, wherein a voltage offset output by each gamma amplifier included in an $i^{th}$ stage ($i=2, \ldots, N$) of the gamma amplification circuits from the plurality of gamma amplification circuits is delayed by a time period with respect to a voltage offset output by a gamma amplifier included in an $(i-1)^{th}$ stage of the gamma amplification circuits.

13. The gamma reference voltage generator of claim 12, wherein the gamma reference voltage generator is embedded in a source driver integrated circuit or is included outside.

14. The gamma reference voltage generator of claim 13, further comprising a control unit configured to conduct a control such that the offset of each gamma amplifier included in the $i^{th}$ stage of gamma amplification circuit is delayed than the offset of each gamma amplifier included in the $(i-1)^{th}$ stage of gamma amplification circuit.

* * * * *